US006677842B1

(12) United States Patent
Hanke et al.

(10) Patent No.: US 6,677,842 B1
(45) Date of Patent: Jan. 13, 2004

(54) LOAD DISCONNECTING SWITCH ESPECIALLY FOR USE IN MOTOR VEHICLES

(75) Inventors: Martin Hanke, Berlin (DE); Bernd Saffian, Berlin (DE); Thomas Hähnel, Berlin (DE); Rainer Vogel, Teltow (DE); Karsten Pietsch, Berlin (DE)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 10/089,484

(22) PCT Filed: Sep. 28, 2000

(86) PCT No.: PCT/DE00/03463

§ 371 (c)(1),
(2), (4) Date: Jul. 26, 2002

(87) PCT Pub. No.: WO01/24214

PCT Pub. Date: Apr. 5, 2001

(30) Foreign Application Priority Data

Sep. 29, 1999 (DE) ..... 199 46 735

(51) Int. Cl.[7] ..... H01H 9/20; H01H 47/04

(52) U.S. Cl. ..... 335/177; 335/167; 335/168; 335/170; 335/171; 335/179; 335/180; 335/181

(58) Field of Search ..... 335/78–86, 132, 335/177–184, 167–171

(56) References Cited

U.S. PATENT DOCUMENTS 3,683,239 A * 8/1972 Sturman ..... 361/194
3,925,742 A 12/1975 Muench ..... 335/186
6,049,265 A 4/2000 Hahnel et al. ..... 335/220

FOREIGN PATENT DOCUMENTS

| | | |
|---|---|---|
| DE | 1151569 | 7/1963 |
| DE | 4110240 | 10/1992 |
| DE | 19701933 | 2/1998 |
| DE | 19741919 | 3/1999 |
| EP | 0727801 A2 | 8/1996 |
| FR | 1420559 | 2/1966 |
| FR | 1502300 | 2/1968 |
| GB | 2202378 A | 9/1988 |

* cited by examiner

*Primary Examiner*—Ramon M. Barrera
(74) *Attorney, Agent, or Firm*—Baker & Daniels

(57) ABSTRACT

A load-disconnecting switch has a permanent-magnetic holding circuit. A coil (5), upon excitation thereof, generates a magnetic flux that is opposite to the magnetic flux of the permanent magnet (9). The armature (6) is biassed to an open position by an armature spring (10), so that the armature spring (10), when a defined operational excitation is exceeded, detaches the armature (6) from the core (7) of the magnet system, allowing said armature to open and thereby disconnecting a switching contact (15) and a fixed contact (16). The load-disconnecting switch can be switched on again by means of a spring clip (12) acting on said armature (6).

8 Claims, 4 Drawing Sheets

LOAD DISCONNECTING SWITCH ESPECIALLY FOR USE IN MOTOR VEHICLES

Figure 1:
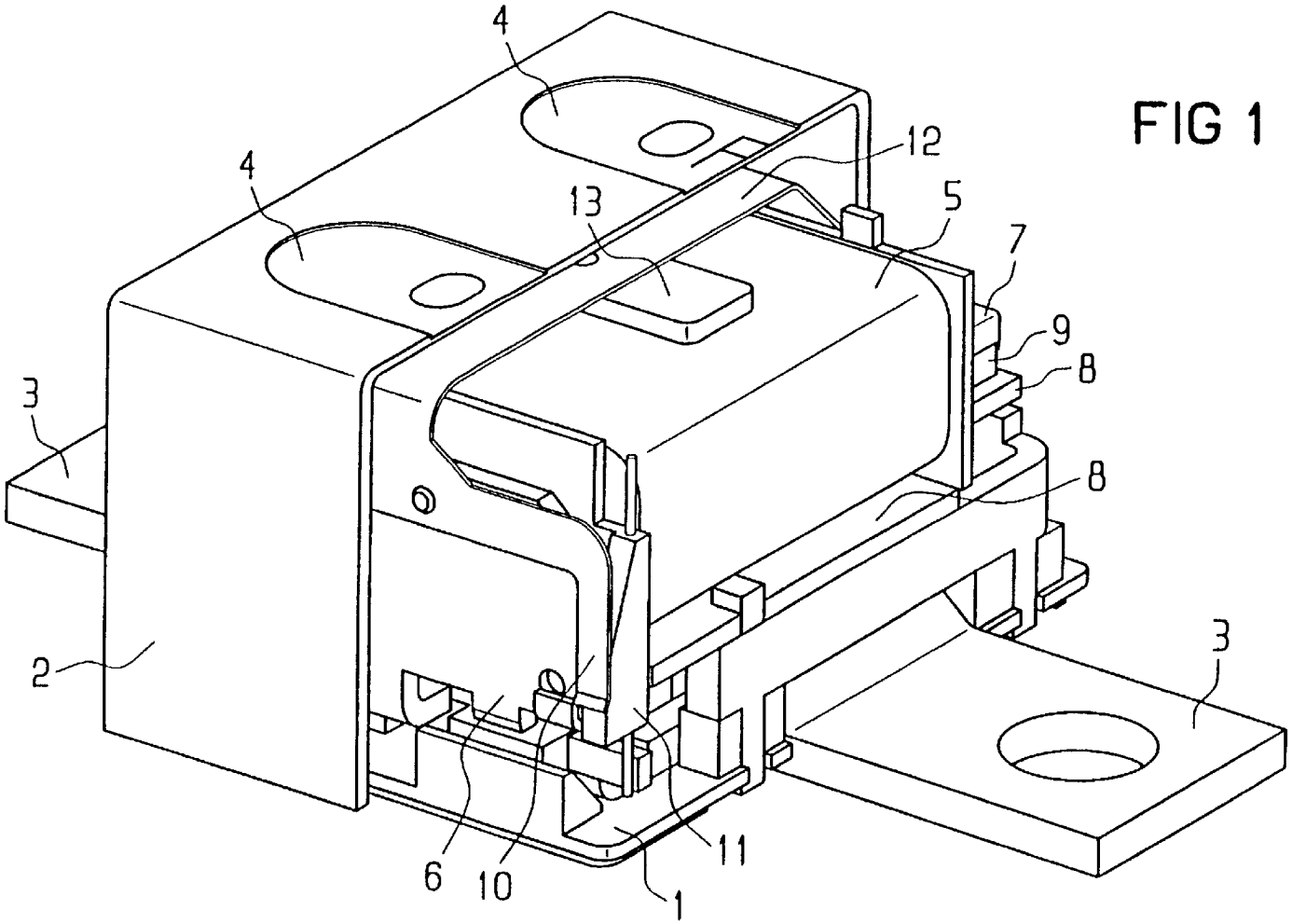

The invention relates to a load-disconnecting switch, in particular for the load circuit of a vehicle battery, in which the load circuit can be disconnected automatically via an electromagnet system.

In motor vehicles, it is desirable in specific disturbance situations to disconnect the on-board network to a dead state abruptly. Such cases are, for example, a short in the load circuit that may lead to battery discharge or vehicle burning, wrong polarization in the event of starting aid which may cause damage to the battery, but also destruction of the electronic systems in the on-board network, or a collision accident which may also cause shorts with a resulting risk of burning.

The document DE 41 10 240 C1 already discloses a means for providing protection to a main current path in a motor vehicle. A disconnect situation is determined by various sensors and comparison means and evaluated for disconnecting the circuit. This document mentions as disconnect means, for example, an explosive cap or an electromagnetic actuator, without the construction and function of such an actuator being discussed in more detail.

The document DE 197 01 933 C1 reveals a load-disconnecting switch for the load circuit of a vehicle battery, in which a contact arrangement is connected between a pole terminal and a load circuit. In case of occurrence of a disturbance situation, the contact arrangement is unlocked via an electromagnet system and the circuit is interrupted. This known load-disconnecting switch comprises an arrangement having a contact rocker with a comparatively large number of individual parts necessitating corresponding manufacturing expenditure and volume.

It is the object of the present invention to provide a load-disconnecting switch that is of simple construction, does not switch unintentionally even in case of high accelerations and is of low volume.

According to the invention, this object is met with a load-disconnecting switch comprising:

- a housing having a base and a housing cover,
- a magnet system having a coil, a core arrangement and an armature, the core arrangement having a permanent-magnetic section exerting a holding force through which the armature is attracted to pole areas of the core arrangement, and said magnet system being adapted to be excited contrary to said permanent-magnetic section,
- an armature spring biasing the armature to an open position, with the holding force of the permanent-magnetic section with attracted armature being higher than the spring force of the armature spring,
- a contact system having a contact spring, a switching contact arranged on the contact spring and a fixed contact cooperating with the switching contact,
- first and second connecting conductors extending out of said housing for connection of the switching contact and the fixed contact.

An essential element of the load-disconnecting switch is the permanent-magnetic section of the core arrangement. It has the effect that the magnetic circuit has an attracted armature in the rest state and, thus, has no movable parts in the rest state having no holding force applied thereto. This has the advantage that the construction provides particular strength with respect to acceleration. In case of use as a battery disconnecting switch in a motor vehicle, it is ensured that also in case of high acceleration forces, e.g. in an accident situation, the load-disconnecting switch is not triggered prior to the airbag. Moreover, in case of accidental dropping during assembly, the risk of damage to the movable parts is reduced. Electric excitation of the coil causes release of the armature, since the excited coil generates a magnetic flux opposite to the magnetic flux generated by the permanent magnet. Consequently, the matching spring force of an armature spring is sufficient for opening the armature. The use of a permanent magnet as holding member permits the necessary driving power to be kept very low. In this manner, it is possible to realize a particularly compact constructional volume.

In an advantageous embodiment, additional mechanical locking is provided. The necessary release force may thus be reduced further. In addition thereto, this locking provides for increased strength with respect to acceleration.

In a preferred embodiment, the armature spring has an extension in the form of a spring clip realizing a manual closing and release button. It is expedient in this respect when the spring clip extends along an outside of the housing cover. It is particularly advantageous when the housing cover is resilient in specific portions so that a force can be exerted on the spring clip from outside of the housing.

Further details and developments of the invention are indicated in the dependent claims.

Figure 2:
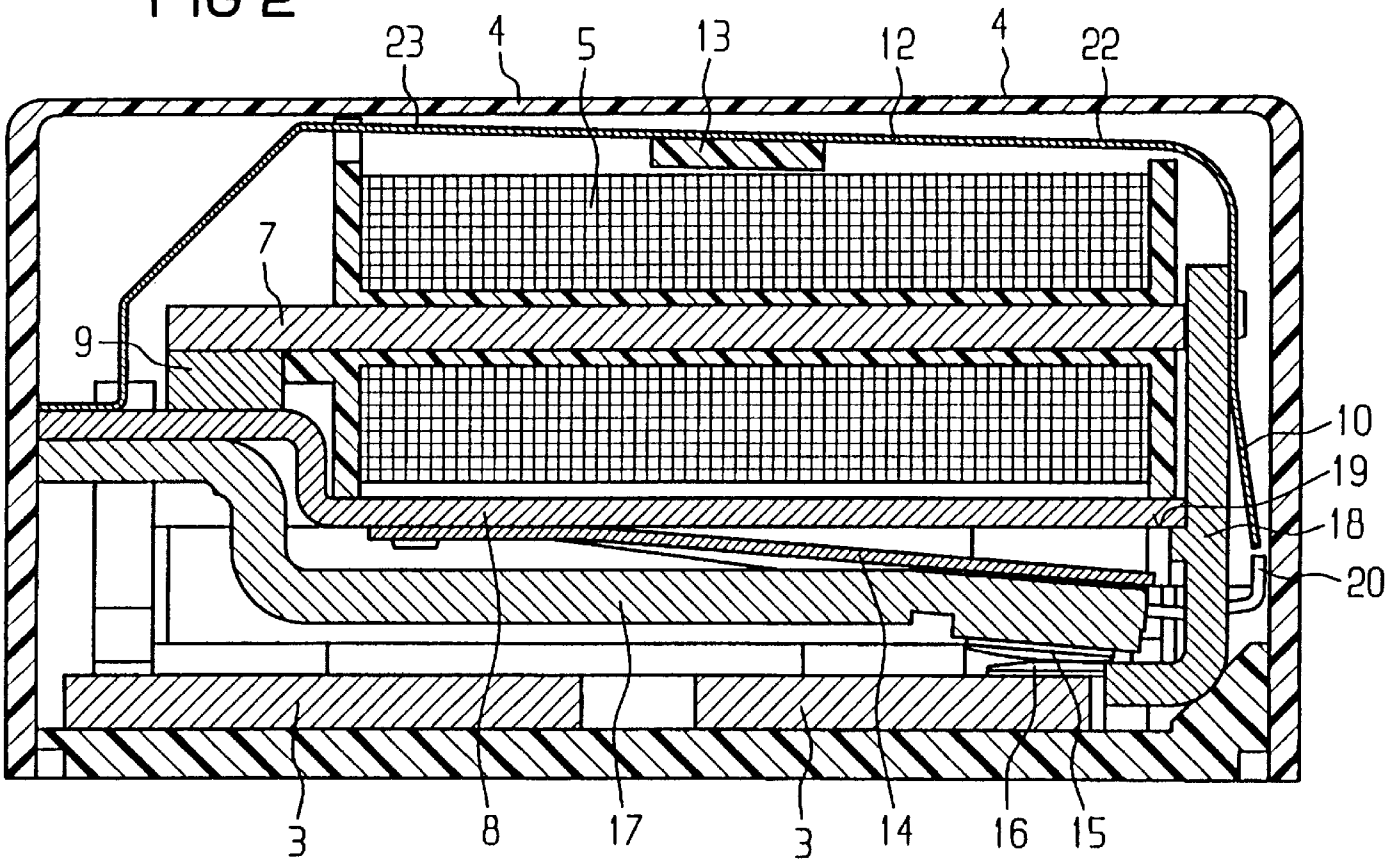
Figure 3A:
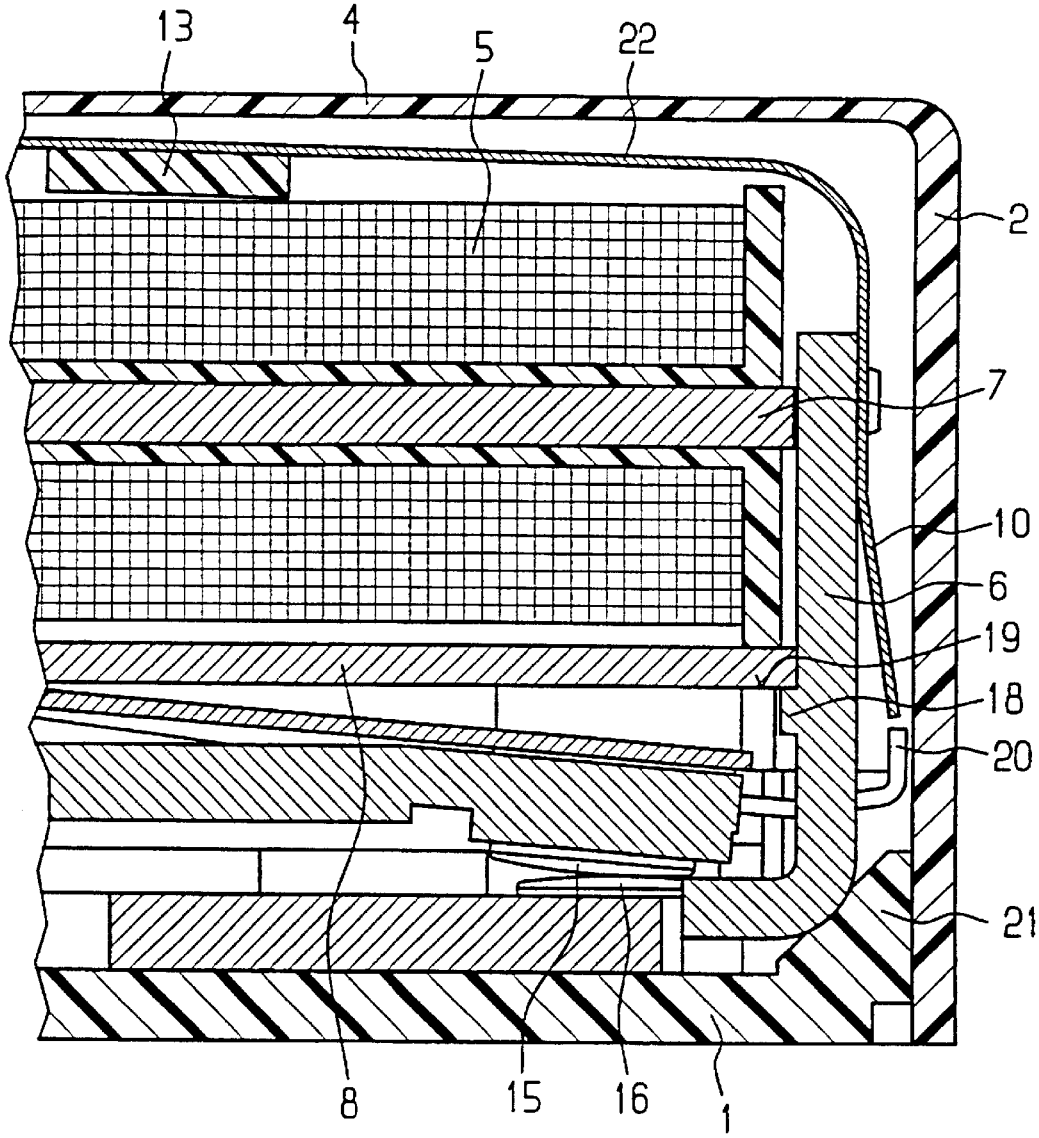
Figure 3B:
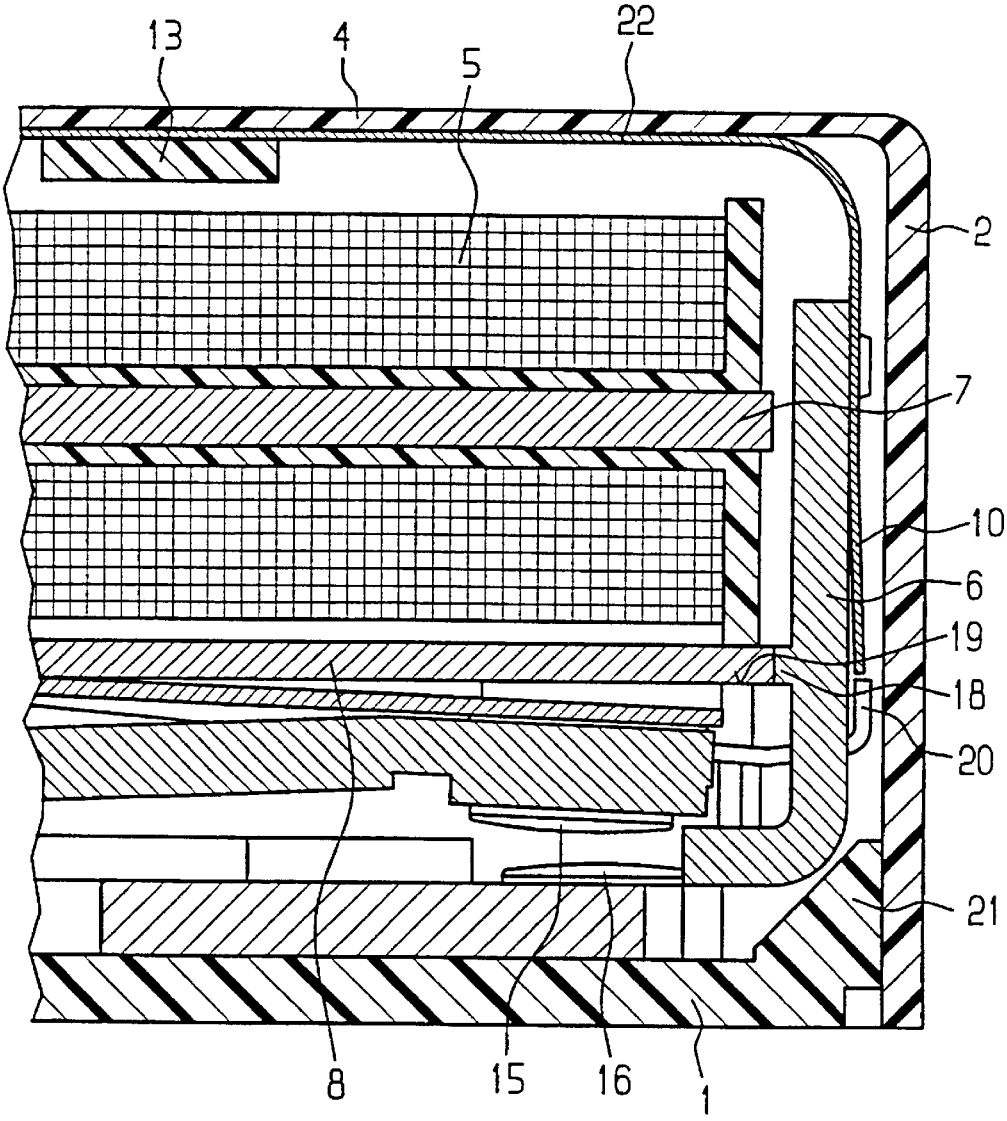

The invention will be elucidated in more detail hereinafter by way of an embodiment illustrated in the drawings in which FIG. 1 shows a load-disconnecting switch according to the invention, with the housing cover being partly cut open, in a three-dimensional representation;

FIG. 2 shows the load-disconnecting switch of FIG. 1 in a longitudinal sectional view; and FIGS. 3A, 3B show the load-disconnecting switch in two functional phases in a longitudinal sectional view.

FIG. 1 gives an outline of a load-disconnecting switch according to the invention, in which the three-dimensional representation reveals part of the magnet system through the partly cut open housing cover. The members of the load-disconnecting switch are arranged on a base 1. A housing cap or cover 2 is slid over the arrangement and, together with base 1, constitutes a closed housing. There are two connecting conductors 3 extending out of housing 1 and 2, to which the load circuit of a vehicle may be connected. Housing cover 2 has two resilient push portions 4 through which the load-disconnecting switch may be manually switched on and off. Of the magnetic circuit of the load-disconnecting switch, a coil 5, an armature 6, a core 7, a yoke 8 and a permanent magnet 9 can be seen. On the side of coil 5 directed away from armature 6, the yoke 8 has a Z-shaped crank such that the cranked portion is arranged parallel to the portion of core 7 projecting from the coil. Between the two parallel portions of yoke 8 and core 7, there is left a gap receiving the permanent magnet 9. The possibility of simple mounting of permanent magnet 9 is an advantage of this construction, since permanent-magnetic materials are brittle and thus sensitive. The core arrangement consisting of core 7, permanent magnet 9 and yoke 8 constitutes together with armature 6 a closed magnetic circuit with permanent magnetic flux caused by permanent magnet 9. As regards driving of the coil 5, it is provided that the magnetic flux generated by the coil counteracts, i.e. is opposite to the magnetic flux generated by permanent magnet 9.

Armature 6 is biased to the open position by an armature spring 10. The latter is riveted to armature 6 in an upper portion of the same and is supported near the free spring end thereof on a supporting portion 11 which in the present embodiment is provided as part of a coil body flange. Another possibility of providing a supporting portion would be to extend the yoke 8 to such an extent that the armature spring 10 can be supported on yoke 8. In that case, the armature 6 possibly would have to be provided with recesses so that the yoke 8 or yoke portions can project through the armature.

In an extension, armature spring 10 extends in curved manner around the coil 5 and is attached on the side of the coil directed away from armature 6.

The thus formed spring clip 12 extends parallel to, and spaced closely from, the top side of housing cover 2. By means of the push portions 4, a force can be applied to spring clip 12. In this manner, a manual closing and release button is realized, with the function thereof being described hereinafter by way of FIG. 2. In the middle of spring clip 12, a pressure plate 13 is mounted to spring clip 12 such that it is located between spring clip 12 and the winding of coil 5. In this manner, the spring clip 12 has a firm support at this location, so that a rocker is formed. The push portions 4 for switching on and off are thus clearly separated. As an alternative, there may be provided, for example, an additional flange or web on the coil body that takes over the function of supporting the spring clip 12. In that event, shrinkage of the winding package due to aging has no influence on the supporting point of the spring clip 12.

FIG. 2 illustrates in addition a contact system. The latter consists of a contact spring 14 that is mounted on the yoke 8 and carries a switching contact 15 on its other end. This contact cooperates with a fixed contact 16 attached to one of the connecting conductors 3. As the load-disconnecting switch is provided for carrying very high currents, the contact spring is not sufficient to carry this current. The load-disconnecting switch thus has an additional strand 17 establishing a low-impedance connection to switching contact 15. Another reason for employing an additional strand 17 consists in that contact spring 14 is made of a material withstanding the mechanical stress. However, advantageous mechanical properties necessitate that the material be of relatively high resistivity. In the mounting region of strand 17 on yoke 8, there is provided the connection to the other one of the connecting conductors 3. On the side of armature 6 facing coil 5, armature 6 has a locking lug 18 provided thereon so as to abut an edge 19 of yoke 8 when contacts 15 and 16 are closed. The locking lug 18 is provided, for example, as an embossed projection. The armature 6 itself is L-shaped, with the long leg of the L abutting pole areas of core 7 and yoke 8. The transverse leg engages under the free end of contact spring 14 or switching contact 15.

As long as coil 5 is not excited, armature 6 is held in this position due to the holding force of permanent magnet 9. Upon excitation of coil 5, a magnetic flux is generated in the magnetic circuit which is opposite to the magnetic flux generated by permanent magnet 9 and thus weakens the same. If coil 5 is excited to a sufficient extent, the opening force exerted by armature spring 10 on armature 6 is greater than the holding force of permanent magnet 9. Thus, a small air gap is formed between core 7 and armature 6. This air gap effects a strong increase in magnetic resistance of the magnetic circuit. This causes an abrupt decrease in the holding force, and the armature spring 10 is capable of completely detaching the armature 6 from core 7 and yoke 8. The gap between armature 6 and yoke 8 increases to such an extent that the locking effect between locking lug 18 and yoke 8 is released. A tear spring 20 engaging in a recess of the armature 6 urges the armature 6 upwardly, with the armature being no longer retained by the locking effect between locking lug 18 and yoke 8. Contact spring 14 and tear spring 20 are made of one piece. During upward movement, the transverse leg of armature 6 pulls switching contact 15 along, so that the connection between fixed contact 16 and switching contact 15 is separated.

FIG. 3A illustrates an enlarged section of the load-disconnecting switch, with contacts 15 and 16 being closed. In FIG. 3B, the contact system is shown with open contacts 15 and 16, with locking lug 18 now abutting the pole area of yoke 8.

The function of the spring clip 12 is understandable from FIGS. 3A and 3B as well. If, with contacts 15 and 16 in the open state, a force is applied to the armature-side half 22 of spring clip 12, which in the present embodiment is effected by pressing the corresponding push portion 4 of housing cover 2, the armature 6 is pushed down. In doing so, contact spring 14 is tensioned via tear spring 20, and switching contact 15 and fixed contact 16 contact each other again, so that the current path between the connecting conductors 3 is closed. Armature 6 is deflected via the ramp 21 of base 1 such that locking lug 18 moves under the edge 19 of yoke 8 into the locked position. If pressure is applied to the half 23 of spring clip 12 remote from the armature, with contacts 15 and 16 being closed, the spring clip 12 is shifted in the direction of armature 6, so that armature 6 is released from core 7, the locking effect is released and the contacts are opened. The resilient design of the push portions 4 for actuating the spring clip 12 has the advantage that there are thus no openings or leaks formed in housing cover 2. For achieving a sealed housing, it is thus only necessary to seal the housing cover 2 with respect to the base 1. This can be achieved by simple casting or sealing.

The operational excitation of the load-disconnecting switch is determined by the holding force of the magnet 9 and the tension of the armature spring 10. For determining a defined operational excitation, there is no mechanical adjustment necessary since an adjustment can be obtained by corresponding magnetization of permanent magnet 9.

What is claimed is:

1. A load-disconnecting switch, preferably for use in motor vehicles, comprising:

a housing have a base and a housing cover, a magnet system having a coil, a core arrangement and an armature, the core arrangement having a permanent-magnetic section exerting a holding force through which the armature is attracted to pole areas of the core arrangement, and said magnet system being adapted to be excited contrary to said permanent-magnetic section, an armature spring biasing the armature to an open position, with the holding force of the permanent-magnetic section with attracted armature being higher than the spring force of the armature spring, a contact system having a contact spring, a switching contact arranged on the contact spring and a fixed contact cooperating with the switching contact, and first and second connecting conductors extending out of the housing for connection of the switching contact and the fixed contact, wherein the armature has a locking lug engaging a yoke edge of the core arrangement and being biased against the yoke edge by a tear spring.

2. A load-disconnecting switch according to claim 1, wherein the switching contact is biased against the fixed contact by the contact spring.

3. A load-disconnecting switch, preferably for use in motor vehicles, comprising:

a housing have a base and a housing cover, a magnet system having a coil, a core arrangement and an armature, the core arrangement having a permanent-magnetic section exerting a holding force through which the armature is attracted to pole areas of the core arrangement, and said magnet system being adapted to be excited contrary to said permanent-magnetic section, an armature spring biasing the armature to an open position, with the holding force of the permanent-magnetic section with attracted armature being higher than the sprint force of the armature spring, a contact system having a contact spring, a switching contact arranged on the contact spring and a fixed contact cooperating with the switching contact, and first and second connecting conductors extending out of the housing for connection of the switching contact and the fixed contact, and wherein the contact spring has at least one tear leg engaging said armature and constituting a tear spring.

4. A load-disconnecting switch, preferably for use in motor vehicles, comprising:

a housing have a base and a housing cover, a magnet system having a coil, a core arrangement and an armature, the core arrangement having a permanent-magnetic section exerting a holding force through which the armature is attracted to pole areas of the core arrangement, and said magnet system being adapted to be excited contrary to said permanent-magnetic section, an armature spring biasing the armature to an open position, with the holding force of the permanent-magnetic section with attracted armature being higher than the sprint force of the armature spring, a contact system having a contact spring, a switching contact arranged on the contact spring and a fixed contact cooperating with the switching contact, and first and second connecting conductors extending out of the housing for connection of the switching contact and the fixed contact, wherein the switching contact is connected to the first connecting conductor by an additional strand.

5. A load-disconnecting switch, preferably for use in motor vehicles, comprising:

a housing have a base and a housing cover, a magnet system having a coil, a core arrangement and an armature, the core arrangement having a permanent-magnetic section exerting a holding force through which the armature is attracted to pole areas of the core arrangement, and said magnet system being adapted to be excited contrary to said permanent-magnetic section, an armature spring biasing the armature to an open position, with the holding force of the permanent-magnetic section with attracted armature being higher than the spring force of the armature spring, a contact system having a contact spring, a switching contact arranged on the contact spring and a fixed contact cooperating with the switching contact, and first and second connecting conductors extending out of the housing for connection of the switching contact and the fixed contact, wherein the armature is substantially L-shaped, with a long leg extending in the region of pole areas of the core arrangement and a transverse leg having its free end engaging the movable part of the contact system so as to open the contacts.

6. A load-disconnecting switch, preferably for use in motor vehicles, comprising:

a housing have a base and a housing cover, a magnet system having a coil, a core arrangement and an armature, the core arrangement having a permanent-magnetic section exerting a holding force through which the armature is attracted to pole areas of the core arrangement, and said magnet system being adapted to be excited contrary to said permanent-magnetic section, an armature spring biasing the armature to an open position, with the holding force of the permanent-magnetic section with attracted armature being higher than the spring force of the armature sprint, a contact system having a contact spring, a switching contact arranged on the contact spring and a fixed contact cooperating with the switching contact, and first and second connecting conductors extending out of the housing for connection of the switching contact and the fixed contact, wherein the armature spring extends around the longitudinal axis of the coil substantially in curved manner, so that a central portion of the armature spring is located close to a housing wall.

7. A load-disconnecting switch according to claim 6, wherein the central portion of the armature spring is supported on a stationary part of the load-disconnecting switch such that a rocker-like arrangement of the armature spring results.

8. A load-disconnecting switch, preferably for use in motor vehicles, comprising:

a housing have a base and a housing cover, a magnet system having a coil, a core arrangement and an armature, the core arrangement having a permanent-magnetic section exerting a holding force through which the armature is attracted to pole areas of the core arrangement, and said magnet system being adapted to be excited contrary to said permanent-magnetic section, an armature spring biasing the armature to an open position, with the holding force of the permanent-magnetic section with attracted armature being higher than the spring force of the armature spring, a contact system having a contact spring, a switching contact arranged on the contact spring and a fixed contact cooperating with the switching contact, and first and second connecting conductors extending out of the housing for connection of the switching contact and the fixed contact, wherein a housing portion close to the central portion of the armature spring has resilient properties so that a force applied from outside the housing can be transferred to the central portion of the armature spring via said resilient housing portion.

* * * * *

UNITED STATES PATENT AND TRADEMARK OFFICE

CERTIFICATE OF CORRECTION

PATENT NO. : 6,677,842 B1
DATED : January 13, 2004
INVENTOR(S) : Martin Hanke et al.

It is certified that error appears in the above-identified patent and that said Letters Patent is hereby corrected as shown below:

Column 5,
Line 15, delete “sprint” and insert -- spring --
Line 38, delete “sprint” and insert -- spring --

Signed and Sealed this

Sixteenth Day of March, 2004

JON W. DUDAS
*Acting Director of the United States Patent and Trademark Office*